US005286366A

United States Patent [19]

Mitsuji

[11] Patent Number: 5,286,366

[45] Date of Patent: Feb. 15, 1994

[54] SURFACE TREATMENT FOR IRON-BASED PERMANENT MAGNET INCLUDING RARE-EARTH ELEMENT

[75] Inventor: Katsuo Mitsuji, Alma, Mich.

[73] Assignee: Hitachi Magnetic Corp., Erdmore, Mich.

[21] Appl. No.: 788,181

[22] Filed: Nov. 5, 1991

[51] Int. Cl.[5] ..... C25D 5/10; C25D 5/34

[52] U.S. Cl. ..... 205/176; 205/181; 205/197; 205/210; 205/217; 427/127

[58] Field of Search ..... 205/176, 181, 197, 210, 205/217; 427/127

[56] References Cited

U.S. PATENT DOCUMENTS

| | | | |
|---|---|---|---|
| 3,090,733 | 5/1963 | Brown | 204/40 |
| 4,100,038 | 7/1978 | Jongkind | 204/38 B |
| 4,384,929 | 5/1983 | Tremmel et al. | 204/40 |
| 5,013,411 | 5/1991 | Minowa et al. | 204/29 |
| 5,082,745 | 1/1992 | Ohashi | 428/552 |

*Primary Examiner*—John Niebling
*Assistant Examiner*—William T. Leader
*Attorney, Agent, or Firm*—Thomas R. Morrison

[57] ABSTRACT

A magnetically anisotropic magnet substrate is coated with a triple layer of nickel plating preferably followed by a chromate layer. The layer of nickel plating includes an inner layer of a non-bright nickel plating, followed by an intermediate nickel-strike layer, followed by an outer layer of a semi-bright nickel plating. The inner layer contains much less sulfur than the other two layers, whereby the resulting difference in electromotive force provides a localized battery that permits the outer layers to be sacrificed without permitting the inner layer to be destroyed. One embodiment adds a copper under-layer below the nickel plating.

4 Claims, No Drawings

SURFACE TREATMENT FOR IRON-BASED PERMANENT MAGNET INCLUDING RARE-EARTH ELEMENT

BACKGROUND OF THE INVENTION

The present invention relates to an improved surface treatment for an iron-based permanent magnet including rare-earth elements and, more particularly, to a permanent magnet having high resistance to mechanical, thermal and/or chemical attack, and also having excellent magnetic properties.

Permanent magnet materials are very important electric and/or electronic materials which are incorporated in various items such as consumer electronic equipment used in homes, motor vehicles and peripheral terminal devices for computers.

Recently, the tendency to reduce in size and to enhance the efficiency of the equipment in which permanent magnets are used has necessitated a further improvement in the characteristics of the permanent magnet materials employed.

A new type of high efficiency magnet, which does not include highly expensive samarium and cobalt, is the R—Fe—B type (where R is one element or a mixture of rare-earth elements including yttrium).

This type of magnet exhibits an extremely high energy product, or (BH) max, of 25 MGOe or more. It includes light rare-earth elements such as Nd and/or Pr and Fe as its main constituent element.

A sintered magnet of Nd—Fe—B is disclosed in European Laid Open Patent Application 0101552 A.

A bulk magnet of Nd—Fe—B type made from rapidly quenched metal flakes (Rapidly Quenched Type of Magnet, hereinafter) is disclosed in European Laid Open Patent Application 0108474 A.

Although these magnets have magnetic anisotropy and a high energy product of 25 MGOe or more, they are inferior to the previous samarium-cobalt type of magnets with respect to corrosion resistance, because they include rare earth elements and iron, both of which are easily oxidized to cause, for example, red rust on their surface. The efficiency of the magnet and the uniformity of magnetic properties decrease when this magnet corrodes.

In order to prevent corrosion of these Nd—Fe—B type of magnets, various methods have been proposed to produce a corrosion resistive layer on their surfaces.

The idea of coating a resin layer on a surface of magnet material is disclosed in Japan Laid Open Patent Application 6377104. Unfortunately, however, the protective layer of resin is generally inferior to a metal plating layer. Because the resin layer is mechanically weaker than a metal plating layer, a scratch is easily made on the resin layer during handling when the resin coated magnet is being inserted into electric equipment. The scratched portion of the resin layer becomes a starting point through which the magnet and the magnet material can be attacked. Even if the resin remains intact, it is inferior to a metal plating layer, because the resin layer is very hygroscopic. It is thus preferable to coat the surface of a magnet body with a metal plating film.

A nickel-plated layer is superior to an oxygen-resist resin layer because the nickel layer itself is mechanically stronger and much less hygroscopic than a layer of resin.

However, it is a problem that a nickel-plated layer typically has many pin holes in contrast to an oxygen-resist resin layer. Because of these pin holes, a magnet body covered by the nickel layer is exposed to corrosion over time by water penetrating through the pin holes to the magnet body, even though the nickel layer itself is not hygroscopic.

The reliability of the corrosion resistive film is reduced if it cannot prevent attack on the substrate through pin-holes. When the substrate is attacked through pin-holes, corroded portions are produced on a magnet body under the protective film, even though a visual inspection indicates that the corrosion resistive film still seems to cover the surface of the magnet. It is important to compensate for the defects in the corrosion resistive metal film to protect the magnet surface.

OBJECTS AND SUMMARY OF THE INVENTION

Accordingly, it is the object of the present invention to provide a highly reliable corrosion resistive layer for a permanent magnet.

It is a further object of the invention to prevent corrosion of a substrate of a permanent magnet due to pin holes in a metal plating film.

It is a still further object of the invention to provide a coating technique for a permanent magnet wherein a metal plating film is deposited on a magnet body and a chromate coating is applied over the metal plating film.

It is a still further object of the invention to provide a coating technique for a permanent magnet consisting of first, second and third nickel coatings preferably followed by a chromate coating. The chromate coating is effective to block pin-holes which may exist in the nickel coatings.

Briefly stated, the present invention provides a magnetically anisotropic magnet substrate that is coated with a triple layer of nickel plating preferably followed by a chromate layer. The nickel plating includes an inner layer of a non-bright nickel plating, followed by an intermediate nickel-strike layer, followed by an outer layer of a semi-bright nickel plating. The inner layer contains much less sulfur than the other two layers, whereby the resulting difference in electro-motive force provides a localized battery that permits the outer layers to be sacrificed without permitting the inner layer to be destroyed. One embodiment adds a copper underlayer below the nickel plating.

According to a feature of the invention, there is provided a surface treatment for a R—TM—X type of permanent magnet material comprising: forming an inner non-bright nickel layer on a surface of the permanent magnet material, the inner non-bright layer including not more than 0.008 wt % of sulfur, forming an intermediate nickel-strike layer on the inner non-bright layer, the intermediate layer including from about 0.1 to about 0.2 wt % of sulfur, and forming an outer semi-bright nickel layer on the intermediate layer, the outer semi-bright nickel layer including from about 0.015 to about 0.03 wt % of sulfur;

where R represents an element or a mixture of rare-earth elements including yttrium, TM is composed of iron as its main component with other transition elements which can be partially replaced by other metal elements and/or other non-metal elements, and X represents an element or a mixture of elements such as B, Nb, and other elements to enhance the coercive force of the magnet material.

According to a feature of the invention, there is provided a method for making a R—TM—X type of permanent magnet material comprising: rapidly quenching alloy flakes to produce a magnet material having an average crystal size of from about 0.02 to about 1.0 μm, hot working the magnet material by hot compression and a plastic deformation in a temperature ranging from about 600° C. to about 800° C. to produce a magnetically anisotropic hot-worked magnet substrate, forming an inner non-bright nickel layer on the substrate, the inner layer including not more than 0.008 wt % of sulfur, forming an intermediate nickel-strike layer on the inner layer, the intermediate nickel-strike layer including 0.1 to 0.2 wt % of sulfur, forming an outer semi-bright nickel layer on the intermediate nickel-strike layer, and the outer semi-bright nickel layer including 0.015 to 0.03 wt % of sulfur.

According to a further feature of the invention, there is provided a permanent magnet comprising: an R-TM-X substrate, a first layer of a non-bright nickel on the substrate, the first layer including no more than 0.008 wt % sulfur, an intermediate nickel-strike layer on the first layer, an outer semi-bright nickel layer on the intermediate nickel-strike layer, and the outer semi-bright layer including at least 0.015 wt % sulfur.

The above, and other object, features and advantages of the present invention will become apparent from the following description.

DETAILED DESCRIPTION OF THE PREFERRED EMBODIMENTS

This invention is a surface treatment for a R-TM-X type of permanent magnet which includes a triple layer of nickel plating comprising:

(1) an inner non-bright nickel layer including not more than 0.008 wt % of sulfur, (2) an intermediate nickel-strike layer including from 0.1 to 0.2 wt % of sulfur, and (3) an outer semi-bright nickel layer including from 0.015 to 0.03 wt % of sulfur, where R represents an element or a mixture of rare-earth elements including yttrium, TM is a mixture, principally of iron, plus transition elements other than iron which can be partially replaced by other metal elements and/or other non-metallic elements, and X is one element or a mixture of elements such a B, N and other elements to enhance the coercive force of the magnet material.

In this invention, the inner not-bright nickel layer, which includes less than 0.008 wt % of sulfur, has a higher electro-motive potential than the intermediate nickel-strike layer or the outer layer which both include more sulfur. These potential differences prevent corrosion of the non-bright nickel layer and, as a result, the corrosion resistance of all of the layers is enhanced. Specifically, the nickel-strike layer and the semi-bright nickel layer will corrode, prior to the corrosion of the non-bright layer, by formation of a localized battery, even if the inner layer is exposed to humidity through pinholes in the nickel-strike layer and the outer layer.

In this invention, the inner layer comprises a non-bright nickel-plated film including not more than 0.008 wt % sulfur. The non-bright nickel layer has a strong adhesion to both the surface of the magnet and the nickel-strike layer. Having a lower sulfur content, the inner layer has a higher electro-motive potential than the nickel-strike layer or the semi-bright nickel plated layer. The sulfur concentration of the nickel-strike layer is between 0.1 and 0.2 wt %. If the sulfur concentration of non-bright nickel-plated layer is more than 0.008 wt %, its electro-motive potential is too low, compared with the nickel-strike layer or the semi-bright nickel plated layer, to prevent corrosion.

If the sulfur content of the nickel-strike layer is less than 0.1 wt %, it cannot perform its role as a sacrificial layer for corrosion for the layers below it. Rather, it would be mechanically weak and would readily flake off the lower layer.

The semi-bright layer preferably has a sulfur concentration of from 0.015 to 0.03 wt %. If the concentration of the semi-bright layer is less than 0.015 wt %, the layer does not have a sufficiently low potential compared with the no-bright nickel layer to prevent corrosion. The upper layer should be a semi-bright nickel-plated layer. If it is a bright nickel-plated layer, the layer would readily corrode and would not be practical. If the concentration of sulfur in the semi-bright layer is higher than 0.03 wt %, the layer could not be protected by the top layer and would be easily colored by corrosion.

The Ni-plating layer is preferably formed by electrolytic plating. The following solution constituents can be used for electrolytic plating. A bath includes from about 50 to about 500 g/l of a nickel salt containing one or a mixture of nickel ammonium sulfate, nickel sulfate, nickel chloride, sulfamic acid nickel, tetrafluoro-nickel borate, from about 10 to about 50 g/l of ammonium chloride, from about 10 to about 50 g/l of boric acid. If necessary, sodium lauryl sulfate or hydrogen peroxide may be included to prevent pits.

For the semi-bright layer, the solution includes a first brightener such as benzene, naphthalene, saccharin and other material. To make the nickel film bright, the solution includes further a second brightener such as butanediol, coumarin, thiourea and similar material.

The plating solution preferably has a temperature of 20° C. to 70° C. and a pH-value of 2.0 to 7.0. The cathode current density is preferably from about 0.1 to about 10 $A/dm^2$ (deci-meters squared). The nickel film produced by the plating solution contains mainly nickel, but it can include a minor amount of impurities such as, for example, iron, copper, manganese, zinc, cobalt, carbon, and/or oxygen. The solution can contain alloying salts to produce a Ni-alloy film including the added metals produced by adding nickel salt and other metal salts to the plating solution.

The element to be alloyed with nickel is generally an element or a mixture of Sn, Cu, Zn, Co, Fe, Cr, P, B and other metal elements. A combination of a non-bright nickel-plated film as an inner layer and a semi-bright nickel-plated film as an outer layer to hold a nickel-strike layer therebetween provides excellent corrosion resistance for the magnet. The underlying non-bright nickel layer is effective to bond the magnet surface to the overlying nickel-strike layer and the semi-bright nickel plated layer. The overlying semi-bright nickel layer is effective to protect the underlying non-bright nickel layer from corrosion.

Adding a chromate film over the Ni-triple layer remarkably enhances the resistance to corrosion.

The corrosion resistance is insufficient when the thickness of the underlying non-bright nickel film is less than 1 μm. However, the cost of material makes it preferable to keep the thickness of the non-bright nickel film less than 50 μm. A preferable thickness of the non-bright nickel-plating film is from about 5 μm to about 25

μm. A more preferable thickness of the non-bright nickel-plating film is from about 10 μm to about 20 μm.

The corrosion resistance is insufficient when the thickness of the overlying semi-bright nickel film is less than about 0.5 μm. However, the cost of materials makes it preferable to keep the thickness of the semi-bright nickel film less than 30 μm. A preferable thickness of the semi-bright nickel-plating film is from about 1 μm to about 15 μm. A more preferable thickness of the non-bright nickel-plating film is from about 2 μm to about 10 μm.

The efficiency of the nickel-strike layer is insufficient when the layer thickness is less than 0.1 μm. However, the cost of material makes it preferable to keep the thickness of the nickel-strike film less than 3 μm. A preferable thickness of the nickel-strike film is from about 0.2 μm to about 1.0 μm.

In order to make a protective film on a magnet surface reliable, it is important to remove a surface layer whose quality has been changed qualitatively by, for example, working or cutting.

Such a surface layer generally has a thickness of 5 μm to 20 μm. The surface layer is qualitatively changed by grinding, cutting or similar mechanical operations.

Previously it was tried to remove such a changed layer and to make the magnet surface active by etching with sulfuric acid or a similar acid before metal plating. This was unsuccessful since corrosion under the plating layer destroyed adhesion and permitted the plated metal film to be removed.

In this invention, the surface layer is removed by a first etching using from about 0.2 to about 10 vol % of nitric acid followed by a second etching using a mixture of from about 0.2 to about 10 vol % of oxygenated water and from about 10 to about 30 vol % of acetic acid.

Copper-plating before the formation of Ni-plating layers is preferable to improve the corrosion resistance of the protective film on the surface of the magnet material.

The copper plating before the nickel plating is effective to reduce the number of pin-holes in the plated nickel film and to improve the uniformity of the plated nickel film.

The plated copper layer under the plated nickel film improves the plating ability of the nickel-plating solution. For example, a complex-shaped magnet can be plated with a uniform thickness of nickel because of the plated copper under-layer. A plated copper under-layer permits nickel plating a ring magnet.

A preferable thickness of the plated copper film is from about 0.5 μm to about 15 μm.

In this invention it is preferable that a corrosion resistance film is formed on surface of a magnet comprising from about 5 to 40 wt % of R, 50 to 90 wt % of TM and 0.2 to 8 wt % of B and including 0.5 to 15 wt % of Co and 0.5 to 5 wt % of aluminum.

The grain boundary phase of a R-Fe-B type of magnet alloy comprises almost a rare-earth rich phase which includes several wt % of Fe and a small amount of boron and a boron rich phase of $R_{1+c}TM_4B_4$ when the magnet does not include Co or Al. The rare-earth rich phase degrades the corrosion resistance of the magnet due to its high chemical activity.

The problem of rare-earth richness at the grain boundaries of a R-Fe-B type of permanent magnet may be reduced by the addition of Co and Al to produce a multiple phase in the grain boundaries. By adjustment of the amount of Co and Al in the permanent magnet, it is possible to enhance the corrosion resistance of the magnet without reducing the magnetic properties. Co is effective to enhance its Curie temperature, the corrosion resistance of the magnet material and the magnetization value, Is. However, less than 0.5 wt % of Co is not effective to enhance these properties. However, an amount of 15 wt % or more of Co reduces the coercive force iHc by causing precipitation of the R-Co compound comprising 40 wt % or more of Co caused by a high condensation of cobalt at the crystalline boundaries which makes reversal of magnetization easier. The preferable range of Co amount is from about 0.5 wt % to about 15 wt % and most preferable from about 1 wt % to about 10 wt %.

Aluminum in addition to Co is effective to enhance iHc and corrosion resistance by preventing reduction of iHc that would be caused by an increase in the amount of Co in the magnet. Less than about 0.5 wt % of Al has reduced effectiveness in enhancing iHc and corrosion resistance. More than about 5 wt % of Al causes a sharp reduction in Br and (BH) max although it is still effective to increase iHc. The most preferable range of Al content is from about 0.5 wt % to about 5 wt %.

In the present invention the transition metal, TM, of the magnet material can include, other than Co and Al, the elements Ga, Ti, V, Cr, Mn, Zr, Hf, Nb, Ta, Mo, Ge, Sb, Sn, Bi, Ni.

The present invention can be applied to permanent magnets produced by a powder metallurgy process or by a process comprising rapidly quenching a molten metal. The latter process generally comprises forming a powder by rapidly quenching the material in a hot atmosphere and compressing the powder to form a compressed body. Compressing is followed by hot working to provide the magnet body with a magnetic anisotropy caused by plastic deformation in the hot atmosphere. The formed bulk magnet is characterized by fine crystalline size of 0.02 μm to 1.0 μm. The magnet to be coated according to the present invention can be produced by the above-described processes, or any modification thereof.

In order to improve corrosion resistance of the triple nickel-plated layers, it is effective to treat the magnet with a chromate treatment by dipping the nickel-plated magnets in a solution including chromium oxide. The chromate film appears to seal the pin holes which occur in the nickel layers.

EXAMPLE

Firstly an ingot having a composition: $(Nd_{0.8}Dy_{0.2})(Fe_{0.7}Co_{0.2}B_{0.07}Ga_{0.03})_{6.7}$, made by an arc-melting process, was pulverized to form a coarse powder by stand-milling followed by disk-milling. The coarse powder was further ground by jet-milling, using nitrogen gas as grinding medium, to produce a fine powder of the alloy having an average particle size of 3.6 μm as measured in a Fisher Sub-Sieve Sizer (FSSS). The FSSS process is a standard industrial process for measuring particle size, and thus requires no further description.

The fine powder was formed/shaped into a green body in a magnetic field of 18 kOe applied perpendicular to the compression direction. The pressure for compression was 2.3 tons/cm$^2$. The green body was sintered in vacuum for two hours at a temperature of 1100° C. The sintered body was cut to produce test pieces having a size of 20×12×6 mm.

The test pieces were heated to a temperature of 900° C. for 2 hours in Ar atmosphere, cooled rapidly to 600° C., held at 600° C. for one hour, then cooled to room temperature.

The surface of the test piece was degreased with trichloroethane, then etched with a 1 vol % solution of nitric acid and then washed in water. After nitric acid etching, the piece was etched in a mixture of 5 vol % of hydrogen peroxide solution and 20 vol % of $CH_3COOH$ solution and then washed in water.

The etched test pieces were treated as follows:

Case 1:

Test pieces were plated with a 3 μm thickness of copper, a 13 μm thickness of non-bright nickel including 0.002 wt % of sulfur, a 0.8 μm thickness of tri-nickel including 0.1 wt % of sulfur and then a 5 μm thickness of semi-bright nickel including 0.025 wt % of sulfur. Then the metal-plated pieces were dipped in a chromic acid solution, washed in water and dried.

Case 2:

Test pieces were plated with a 15 μm thickness of non-bright nickel including 0.001 wt % of sulfur, a 0.6 μm thickness of tri-nickel including 0.15 wt % of sulfur, and then a 5 μm thickness of semi-bright nickel including 0.015 wt % of sulfur. Then the metal-plated pieces were dipped in chromic acid, washed in water and dried.

Case 3:

Test pieces were plated with a 15 μm thickness of non-bright nickel including 0.001 wt % of sulfur, a 0.6 μm thickness of tri-nickel including 0.15 wt % of sulfur, and then a 5 μm thickness of semi-bright nickel including 0.02 wt % of sulfur.

Case 4:

Test pieces were plated with a 20 μm thickness of bright nickel including 0.04 wt % of sulfur.

Case 5:

Test pieces were plated with a 15 μm thickness of non-bright nickel including 0.001 wt % of sulfur and then a 5 μm thickness of bright nickel including 0.05 wt % of sulfur.

To evaluate the oxidation-resistance of the test pieces, we investigated the flaking of the metal plating film caused by oxidation after they had been maintained at a temperature of 120° C., at two atmospheres pressure, in 90% humidity. The test pieces treated by the methods of cases Nos. 1, 2 and 3 were not corroded after 1,000 hours in the test environment. However, the test pieces treated by the method of case 4 exhibited red rust after 200 hours in the test environment, while the test pieces treated by the method of case 5 exhibited red rust after 300 hours.

The test pieces were also subjected to a salt water spray test using a 5 vol % NaCl solution maintained at a temperature of 35° C. After 200 hours in the salt water spray, no red rust was visible on the surfaces of the test pieces treated by the methods of cases 1, 2 or 3. However, the test pieces treated by the method of case 4 developed red rust after 15 hours of exposure to the salt spray, while the test pieces treated by the method of case 5 exhibited red rust after 20 hours exposure.

Having described preferred embodiments of the invention, it is to be understood that the invention is not limited to those precise embodiments, and that various changes and modifications may be effected therein by one skilled in the art without departing from the scope or spirit of the invention as defined in the appended claims.

What is claimed is:

1. A surface treatment for a R-TM-X permanent magnet comprising the steps of:

first etching said surface in nitric acid having a concentration of from about 0.2 to about 10 vol %;

second etching said surface in an aqueous solution containing hydrogen peroxide having a concentration of from about 0.2 to about 10 vol % and acetic acid having a concentration of from about 10 to about 30 vol %;

forming an inner non-bright nickel layer on a surface of said permanent magnet;

said inner non-bright layer including not more than 0.008 wt % of sulfur;

forming an intermediate nickel-strike layer on said inner non-bright layer;

said intermediate layer including from about 0.1 to about 0.2 wt % of sulfur; and forming an outer semi-bright nickel layer on said intermediate layer;

said outer semi-bright nickel layer including from about 0.015 to about 0.03 wt % of sulfur; and applying a chromate coating over said outer semi-bright nickel layer;

where R is about 5 to 40 wt % of said magnet and comprises an element or a mixture of neodymium, praseodymium, and dysprosium, TM represents 50 to 90 wt % of said magnet and is comprised of iron and one or more elements selected from the group consisting of Co, Al, Ga, Ti, V, Cr, Mn, Zr, Hf, Nb, Ta, Mo, Ge, Sb, Sn, Bi, and Ni, X is 0.2 to 8 wt % of an element or a mixture of elements comprising B and N, and the total wt % of R, TM, and X is 100.

2. A surface treatment for a R-TM-X permanent magnet according to claim 1 further comprising copper plating said magnet prior to the step of forming said non-bright nickel layer.

3. A surface treatment for a R-TM-X permanent magnet according to claim 1 wherein said non-bright nickel-plated layer has a thickness of about 5 to about 25 μm, said nickel-strike layer has a thickness of about 0.2 to about 1.0 μm, and said semi-bright nickel-plated layer has a thickness of about 1 to about 15 μm.

4. A surface treatment for a R-TM-X permanent magnet according to claim 1 where said non-bright nickel layer has a thickness of about 10 to about 20 μm, said nickel-strike layer has a thickness of about 0.25 to about 0.75 μm, and said semi-bright nickel layer has a thickness of about 2 to about 10 μm.

* * * * *